US008442260B2

(12) United States Patent
Servadio

(10) Patent No.: US 8,442,260 B2
(45) Date of Patent: May 14, 2013

(54) RIBBON TRANSDUCER

(75) Inventor: Màurizio Servadio, Monte San Vito (IT)

(73) Assignee: Ask Industries Societa' per Azioni, Monte Sanvito (AN) (IT)

( * ) Notice: Subject to any disclaimer, the term of this patent is extended or adjusted under 35 U.S.C. 154(b) by 267 days.

(21) Appl. No.: 12/925,381

(22) Filed: Oct. 20, 2010

(65) Prior Publication Data

US 2011/0091064 A1 Apr. 21, 2011

(30) Foreign Application Priority Data

Oct. 21, 2009 (IT) ..... AN2009A0077

(51) Int. Cl.
*H04R 25/00* (2006.01)

(52) U.S. Cl.
USPC ..... 381/398; 381/399; 381/431

(58) Field of Classification Search ..... 381/176, 381/386, 396, 398, 399, 408, 423, 431; 181/144, 181/166, 171, 172, 173
See application file for complete search history.

(56) References Cited

U.S. PATENT DOCUMENTS

| | | | | |
|---|---|---|---|---|
| 3,564,163 | A * | 2/1971 | Hobrough | 381/399 |
| 4,550,228 | A | 10/1985 | Walker et al. | 179/115 V |
| 5,081,683 | A | 1/1992 | Torgeson | 381/203 |
| 2006/0078152 | A1 * | 4/2006 | Royer et al. | 381/399 |

FOREIGN PATENT DOCUMENTS

| | | |
|---|---|---|
| EP | 0 404 487 | 12/1990 |
| GB | 209761 | 9/1924 |
| JP | 2008 187311 | 8/2008 |

* cited by examiner

*Primary Examiner* — Huyen D Le
(74) *Attorney, Agent, or Firm* — Lowe, Hauptman, Ham & Berner, LLP

(57) ABSTRACT

A ribbon transducer (101) is disclosed, comprising: a ribbon made of conductive material (2), a damping system (4) arranged at least at one end of the conductive ribbon (2), and two rigid supports (103) where the ends of the ribbon (2) are fixed. The damping system (104) comprises a suspension composed of at least one wire (105), anchoring means (107) to connect said ribbon (2) to said wire (105), and elastic means (150) operatively connected to said wire to generate mechanical stress.

14 Claims, 4 Drawing Sheets

RIBBON TRANSDUCER

The present patent application for industrial invention relates to a ribbon transducer, in particular for loudspeakers and microphones.

In general ribbon transducers are fixed at their ends to a rigid support, in such a way to be tensioned to vibrate and generate an acoustic signal.

However, these types of ribbon transducer have a short life because they tend to tear during operation or because tensioning is loosened with performance degradation.

These problems are at least partially solved by the European patent EP 0 404 487 (Celestion) that discloses an elastic damping element shaped as a plate that is glued to a portion of ribbon in the proximity of the end. In any case, both the end of the ribbon and the end of the elastic element are fixed to a rigid support element.

The solution disclosed in EP 0 404 487 is impaired by several drawbacks.

The ribbon cannot be suitably tensioned, otherwise the elastic element would detach from the ribbon. Because of this, good performance is not obtained and the tension of the ribbon cannot be set according to the needs and type of sound to be produced.

The ribbon only has a unilateral asymmetric curvature and consequently the elastic damping element has a limited travel with respect to the constraints. So the ribbon can break in case of multi-directional stress, for example orthogonal distractions with respect to the longitudinal axis of the ribbon.

The elastic damping element is flat, non-conductive (therefore not active) and has the same width as the conductive ribbon. Therefore the elastic damping element introduces an asymmetry, and most of all a spurious emission caused by its geometry. In fact, such an elastic element can be efficiently coupled with air and produce a sound that in such a situation interferes with the primary source (sound emitted by the ribbon) that should be instead the only one to generate a sound.

Such a system is characterized by complex assembly, since it provides for two anchoring points to the rigid support. In fact, both the end of the ribbon and the end of the elastic element must be fixed to the rigid support. Moreover, damping material must be necessarily inserted in the folding area of the ribbon to reduce mechanical and acoustic interference.

The U.S. Pat. No. 5,081,683 discloses a suspension system for a diaphragm loudspeaker, the precepts of which can be also applied to a ribbon loudspeaker.

The purpose of the present invention is to eliminate the drawbacks of the prior art, by devising a ribbon transducer that is reliable, efficient, efficacious and simple to make and assemble.

Another purpose of the present invention is to provide such a ribbon transducer that can be easily mounted and suitably tensioned, guaranteeing good sound quality and long life.

These purposes have been achieved by the invention with the characteristics illustrated in the attached independent claim 1.

Advantageous embodiments are disclosed in the dependent claims.

The ribbon transducer of the invention comprises:

a ribbon made of conductive material, a damping system arranged at least at one end of the conductive ribbon, and two rigid supports where the ends of the ribbon are fixed.

The damping system comprises:

a suspension made of at least one wire, anchoring means to connect said ribbon to said wire, and elastic means operatively connected to said wire to create mechanical tension.

Such a solution with elastic damping elements connected to a wire is characterized by several advantages compared to the prior art.

Deformation is obtained (necessary for the ribbon travel) at the ends of the conductive ribbon, symmetrical with respect to the axis of traction that also allows for dynamically balancing the positive and negative oscillations of the transducer.

The wires arranged at the ends of the ribbon are acoustically inert, since their radiant surface is very small and has a circular profile, therefore with very low mechanical-acoustic impedance (poor capacity of sound generation), giving the transducer a very high linearity and a practically zeroed spurious emission (improperly emitted sounds).

The transducer of the invention allows for tensioning the ribbon by applying two opposite forces only at the ends of the ribbon, such that the ribbon is given mechanical stability and apparent rigidity that are otherwise impossible to achieve. Such a high traction force is also able to compensate significant elongation caused by thermal and mechanical stress. The force applied at the ends can be expressed in approximately 10 Kg, but such a force depends on the acoustic characteristics to be given to the system (for example, by tensioning with 20 Kg a high resonance frequency is obtained in combination with a high mechanical damping, if the force is lower, for example 2 Kg, a very low resonance and a tendency to reproduce low frequencies are obtained). This is important because it allows for a very large margin of maneuvering in choosing the force to be applied to set the acoustic behavior of the transducer in compliance with the requirements.

Moreover, it must be noted that the transducer of the invention provides for a single fixing point of the ribbon to the lateral rigid supports. In fact, the ribbon is fixed only at the end that is pulled and fixed to the relevant rigid support. Such a configuration allows for achieving the mechanical fixing and electrical connection of the ribbon in a single assembly operation.

The transducer of the invention allows for determining its final shape, which will only be obtained when assembly is finished, without the need to provide for a complete frame that forms the loudspeaker.

The transducer of the invention provides for a ribbon that has suspensions and relevant anchoring and fixing points in specific unmodifiable positions, giving the transducer a standardization that is not achieved in the solutions of the prior art.

In summary, the transducer of the invention is characterized by the following advantages with respect to transducers of the prior art:

the ribbon of the transducer of the invention can be tensioned with significant forces that can modify the acoustics.

The transducer of the invention is acoustically inert, whereas the known types of transducer have spurious emissions that depend on the geometry of the damping system.

The transducer of the invention is symmetrical with respect to the ribbon constraint, whereas the known types are asymmetrical.

Additional characteristics of the invention will appear more evident from the following detailed description that refers to merely illustrative, not limiting embodiments, illustrated in the enclosed drawings, wherein.

Referring to FIGS. 1 to 5, an embodiment of a ribbon transducer is described, generally indicated with numeral (1).

Figure 1:
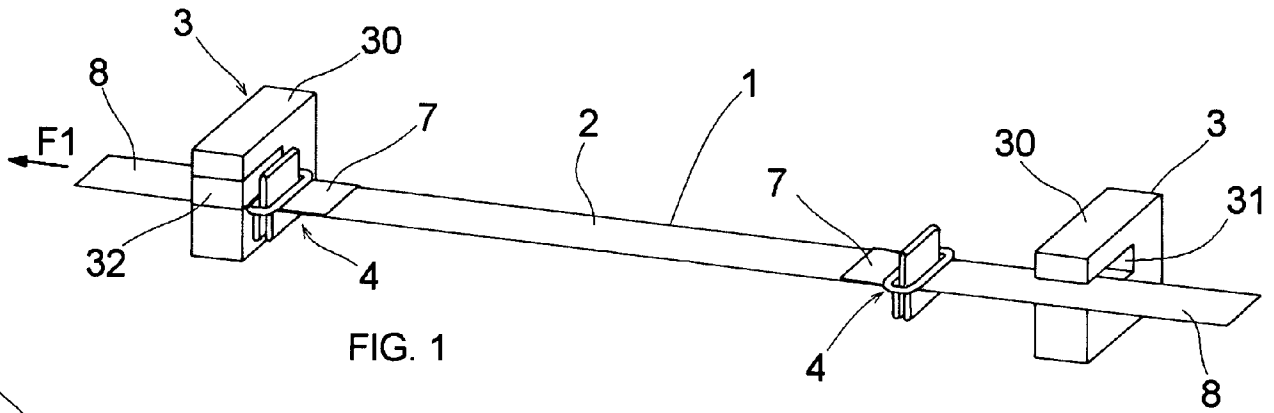
FIG. 1 is a perspective view of a first embodiment of a ribbon transducer, during an assembly phase in which the ribbon is not tensioned.
Figure 2:
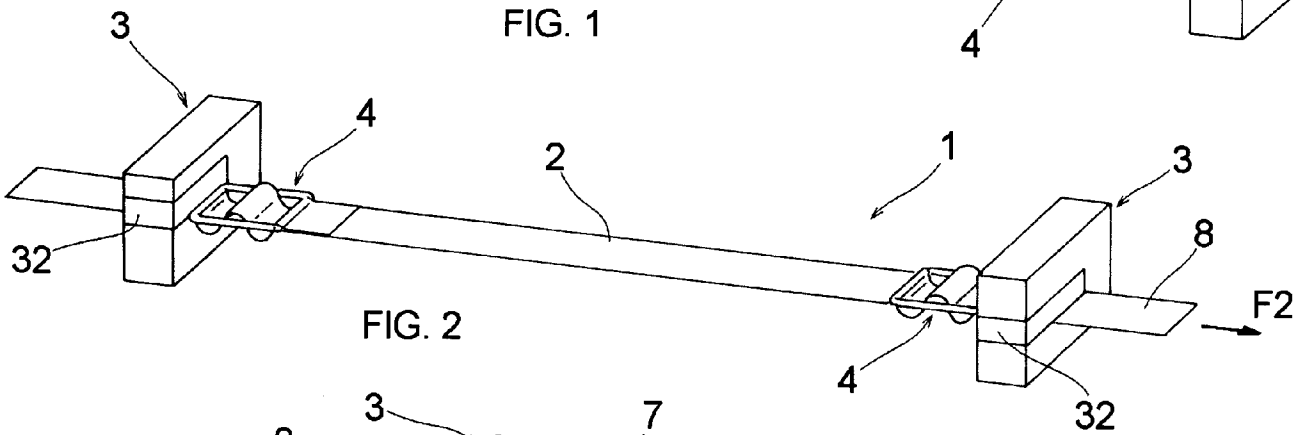
FIG. 2 is the same view as FIG. 1, in which the ribbon is tensioned.
Figure 3:
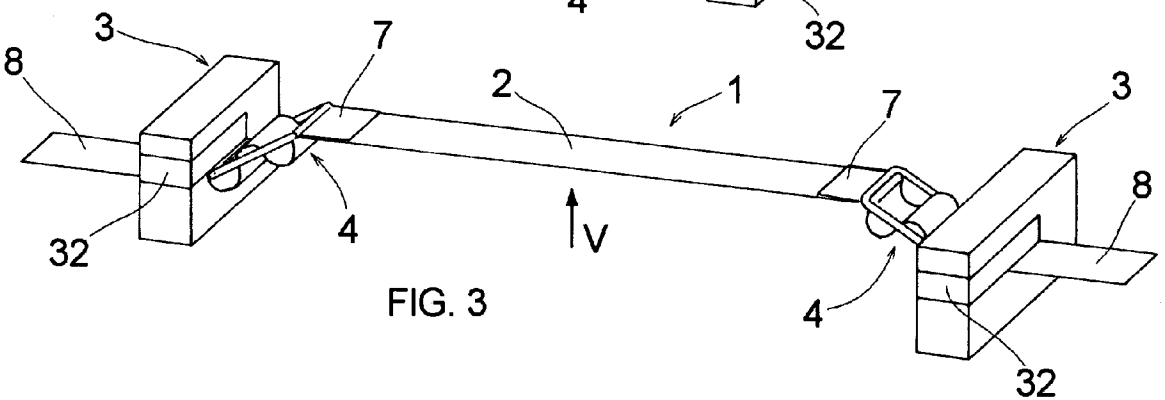
FIG. 3 is the same view as FIG. 2 that shows the ribbon in maximum travel during operation.

Referring now to FIGS. 1-3, the transducer (1) comprises a conductive ribbon (2) made of non-magnetic material, such as aluminum, titanium, beryllium or alloys of non-magnetic materials.

The two ends of the ribbon (2) are fixed to two rigid supports (3) by means of a damping system (4). The supports (3) are provided with electrical contacts adapted to get in contact with the ends of the conductive ribbon (2). In view of the above, when the conductive ribbon (2) is crossed by an electrical signal, it starts vibrating, thus converting the electrical signal into an acoustic signal.

Figure 4:
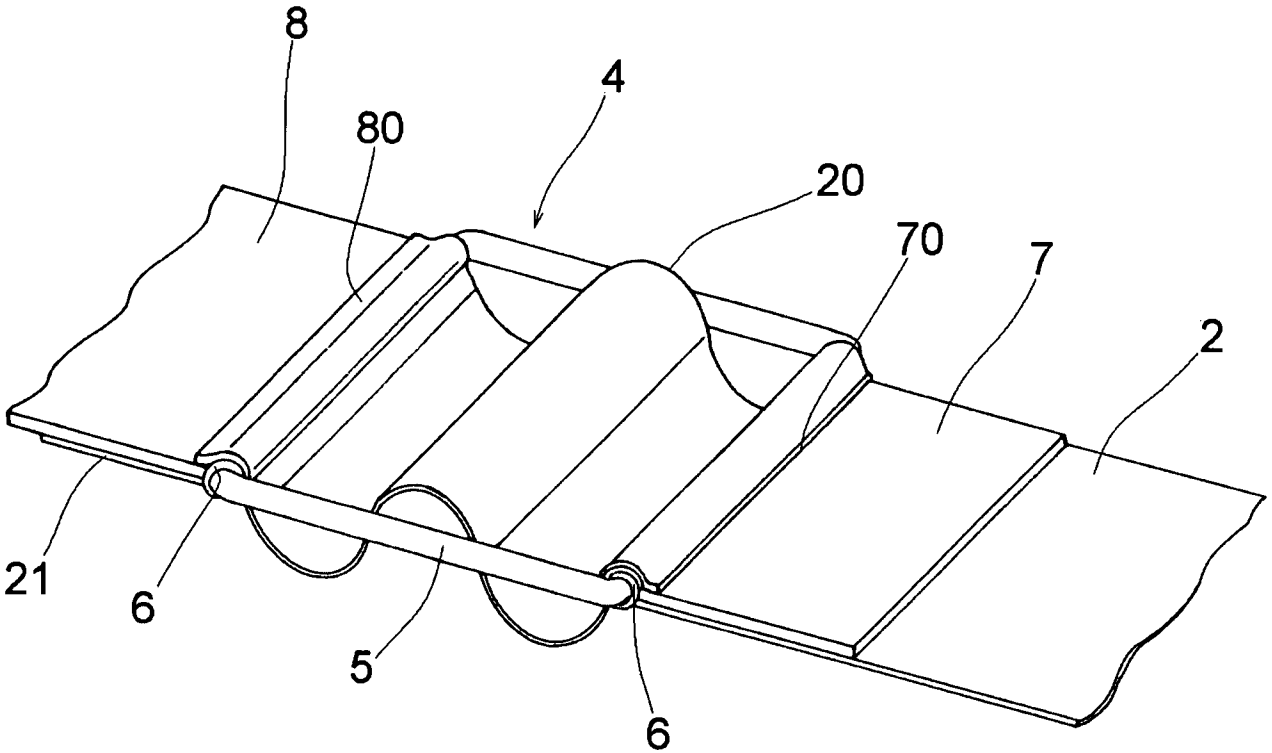
FIG. 4 is an enlarged detail of a portion of FIG. 2, showing the damping system of the ribbon.
Figure 5:
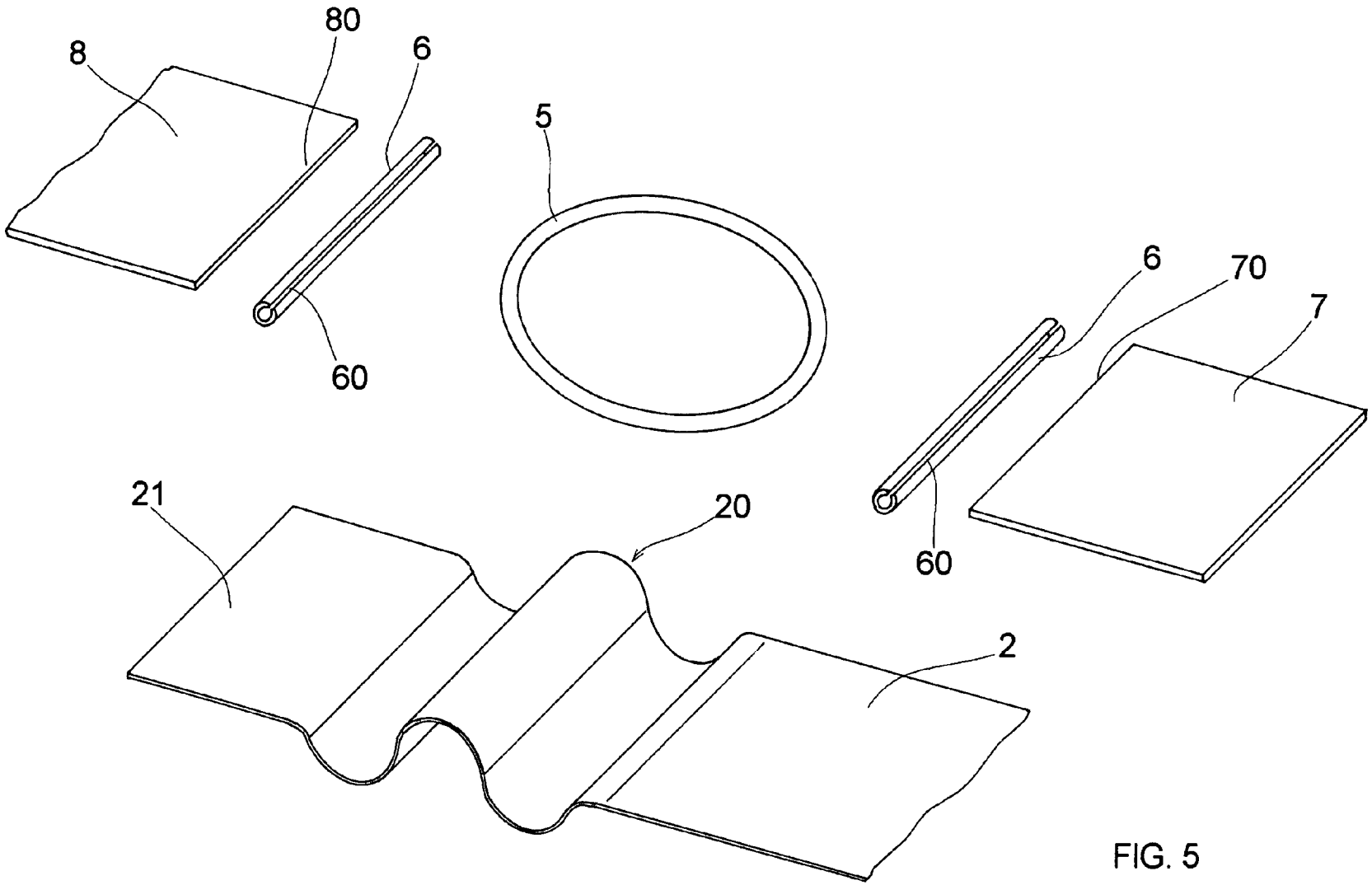
FIG. 5 is an exploded view of the various elements that form the damping system of the ribbon.

Referring to FIGS. 4 and 5, the damping system (4) of the ribbon (2) is disclosed.

The damping system (4) comprises a suspension made of an elastic wire (5). The elastic wire (5) can be made of latex or platinic or peroxy silicone. Advantageously, the elastic wire (5) is arranged in loop configuration and can be for example an O-Ring of known type.

On the elastic wire (5) two rigid pipes (6) are forced, being made of non-magnetic material, such as carbon, titanium, beryllium, magnesium or lithium. The pipes (6) have basically the same width as the ribbon (2) and are arranged in diametrally opposite positions with respect to the centre of the loop of elastic wire (5) in such a way to be parallel.

The rigid pipes (6) are provided with a longitudinal slot (60) in order to be forced on the elastic wire (5) and then closed with crimping. In such a way, the pipes (6) can slide with respect to the elastic wire (5). Alternatively, the rigid pipes (6) can be directly obtained on the elastic wire (5).

The suspension system (4) also comprises a first anchoring strip (7) and a second anchoring strip (8). The anchoring strips (7, 8) are made of inert plastic material. Preferably, the anchoring strips (7, 8) are provided with adhesive at least on one side, advantageously on both sides (bi-adhesive strips). The anchoring strips (7, 8) can be made of polyester made bi-adhesive with acrylics.

The anchoring strips (7, 8) can be also made of rigid materials and mechanically coupled by means of riveting, vibration soldering, or electric soldering. The anchoring strips (7, 8) have a thickness of about 100 micron and basically the same width as the width of the ribbon (2).

The first strip (7) is shorter than the second strip (8). An end (70) of the first strip rotates around a rigid pipe (6) and is fixed on the same strip (7) using the adhesiveness of the strip (7).

Likewise, an end (80) of the second strip rotates around the other rigid pipe (6) and is fixed on the same strip (8) using the adhesiveness of the strip (8).

In such a way a sort of suspender is obtained, being composed of the two stripes (7, 8) connected with the elastic wire (5).

The ribbon (2) is folded in the proximity of the end, in such a way to generate an undulated portion (20), for example a configuration with sinusoidal section with two lower half-waves and one upper half-wave. Clearly, the undulated portion (20) can have only one loop since frontally it does not acoustically see any other material, such as rubber strips or similar. A flat portion (21) is provided between the undulated portion (20) and the proximal end of the ribbon.

Now, the first anchoring strip (7) is fixed on the ribbon (2) near the undulated portion (20) of the ribbon, in such a way that the undulated portion (20) is arranged between the two rigid pipes (6) inside the loop of elastic wire (5).

It must be considered that the transducer (1) does not need damping material between the elastic element (5) and the folded area of the ribbon (20) because neither mechanical nor acoustic interference exists between them.

The fact that the ribbon (2) can be repeatedly folded in the undulated area (20) allows for significant travel to constraints with respect to the size of the suspension with wire (5), while still falling within the maximum permitted volume.

The second anchoring strip (8) is fixed to the flat end portion (21) of the ribbon. The second anchoring strip (8) is longer than the flat portion (21) of the ribbon. Therefore the anchoring strip (8) protrudes more with respect to the ribbon (2).

Going back to FIG. 1, after fixing the two damping systems (4) to the ends of the ribbon (2), the assembly made up of ribbon (2) and damping systems (4) is fixed to the two rigid supports (3).

Each rigid support (3) comprises a base support (30) provided with a groove (31) that is closed with a closing block (32).

Referring to FIG. 1, the left-handed anchoring strip (8) is pulled towards the direction of the arrow (F2), until the elastic loop (5) stops against the left-handed support (3); then the closing block (32) of the left-hand support is closed in such a way to hold the anchoring strip (8).

Then, as shown in FIG. 2, the other anchoring strip (8) is pulled in the direction of the arrow (F2), until the desired tension of the ribbon (2) is obtained; then the closing block (32) of the right-hand support is closed. Now the ribbon (2) is at the required tension, which is maintained by the elastic damping system (4).

FIG. 3 shows that, during operation, the ribbon (2) can make vertical travels, in the direction of the arrow (V), because of the damping systems (4).

Figure 6:
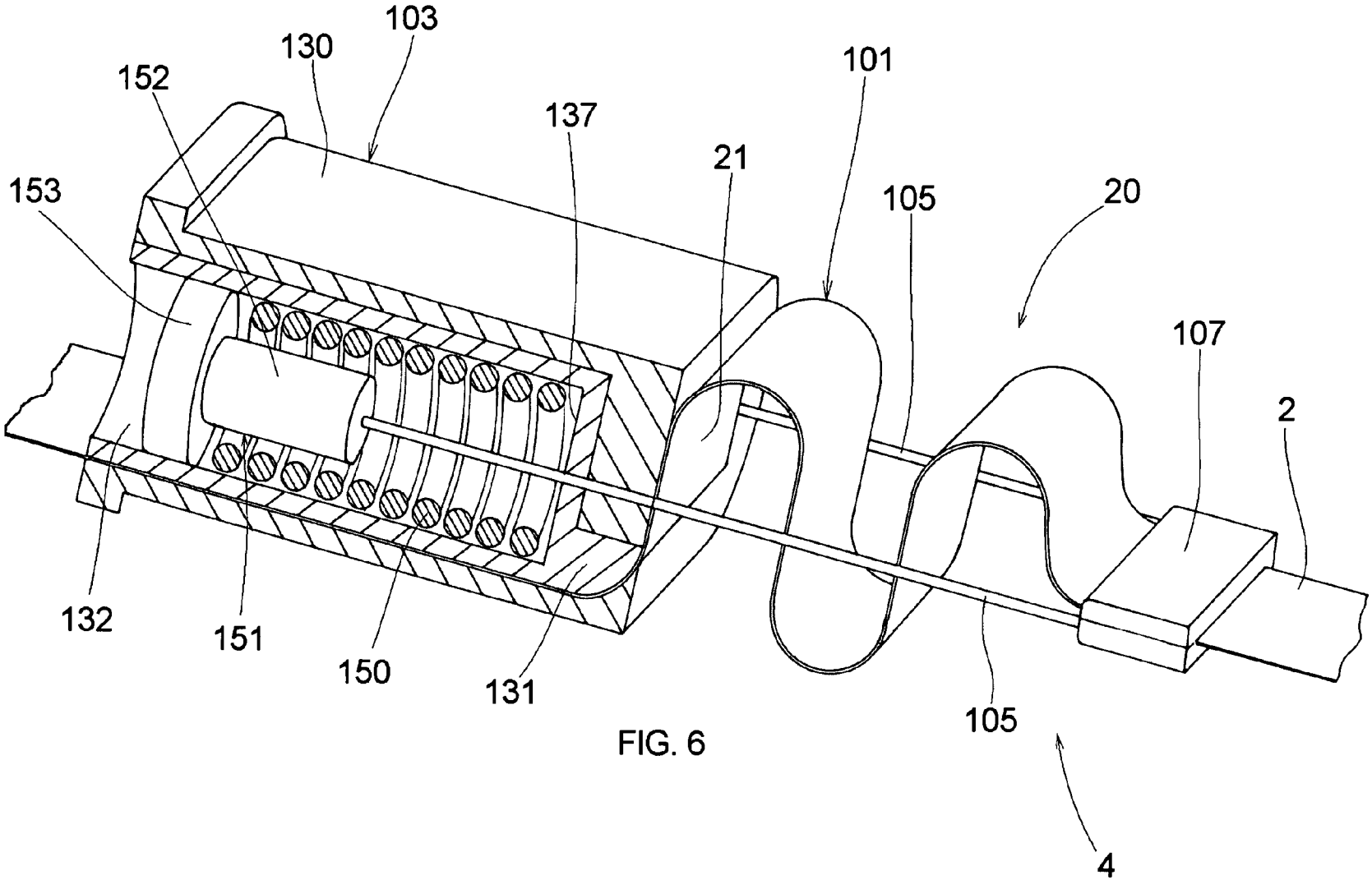
FIG. 6 is a perspective view, partially cutaway and partially interrupted, that shows an embodiment of the ribbon transducer of the invention.

FIG. 6 shows an embodiment of the ribbon transducer of the invention, indicated with numeral (101). In such a case, a wire (105) made of non-elastic, non-magnetic and resistant-material with high tensile strength is used, such as carbon, aramidic fiber, polyamide or polyimide.

The wire (105) is connected to the ribbon (2) by means of a clip (107), in such a way that the undulated portion (20) of the ribbon is between two sections of wire (105) parallel and laying on the plane of the ribbon (2).

The ending part (21) of the ribbon is fixed to the electrical contacts (131) arranged inside a base support (130) of the rigid support (103).

At the two ends of the wire (105) a head (151) is crimped, being slidingly mounted inside a housing (132) obtained inside the contact (131) of the base support. The head (151) has a first shank (152) and a. second shank (153) with higher diameter.

A spring (150) is obtained between a stop surface (137) of the contact (131) and the shank (153) with higher diameter, in such a way to pull the wire (105) in traction. In view of the above the wire (105) acts as elastic wire, as described in the first embodiment of the invention, guaranteeing higher mechanical resistance than an elastic wire.

Numerous variations and modifications can be made to the embodiments of the invention by an expert of the field, while still falling within the scope of the invention as claimed in the enclosed claims.

The invention claimed is:

1. A ribbon transducer (1; 101) comprising: a ribbon made of conductive material (2) and comprising two ends, a damping system (4) arranged at least at one end of the conductive ribbon (2), and two rigid supports (3; 103) where the ends of the ribbon (2) are fixed, said damping system (4) comprising: a suspension made of at least one wire (5; 105), anchoring means (7; 107) to connect said ribbon (2) to said wire (5; 105), and elastic means (5; 150) operatively connected to said wire to create mechanical tension.

2. The ribbon transducer (101) of claim 1, wherein said wire (105) is made of non-elastic material and said elastic means (150) comprise spring means arranged inside said rigid support (103), between an enlarged head (151) at the end of the wire and a stop wall (137) of the rigid support.

3. The ribbon transducer (101) of claim 2, wherein said enlarged head (151) at the end of the wire is slidingly mounted inside a housing (132) of electrical contacts (131) arranged inside said rigid support and adapted to get in contact with said conductive ribbon (2).

4. The ribbon transducer (101) of claim 1, wherein said anchoring means (107) comprise a clip used to clamp said wire (105) and said ribbon (2).

5. The ribbon transducer (101) of claim 1, wherein said wire (105) is made of non-elastic non-magnetic and resistant material with high tensile strength.

6. The ribbon transducer (1) of claim 1, wherein said suspension wire is an elastic wire (5) and said suspension comprises a first anchoring strip (7) and a second anchoring strip (8) fitted at one end of the ribbon (2) and connected by means of said elastic wire (5).

7. The ribbon transducer (1) of claim 6, wherein said elastic wire (5) is shaped as a ring.

8. The ribbon transducer (1) of claim 6, wherein said first strip (7) and second strip (8) are plastic strips adhesivized at least on one side to be adhesively fixed on said ribbon (2).

9. The ribbon transducer (1) of claim 6, wherein said ribbon (2) has an undulated section (20) arranged near its end, between said first anchoring strip (7) and said second anchoring strip (8).

10. The ribbon transducer (1) of claim 9, wherein said undulated section (20) of the ribbon has a sinusoidal configuration comprising at least three half-waves.

11. The ribbon transducer (1) of claim 6, wherein it comprises two rigid tubes (6) made of non-magnetic material, arranged on said ribbon, said first strip (7) and second strip (8) being wound on said rigid tubes (6).

12. The ribbon transducer (1) of claim 11, wherein said rigid tubes are made of carbon, titanium, aluminium, beryllium, magnesium or lithium.

13. The ribbon transducer (1) of claim 6, wherein said elastic wire (5) of the suspension is made of latex or platinic or peroxidic silicone.

14. The ribbon transducer (1) of claim 6, wherein said first strip (7) and second strip (8) are made of polyester bi-adhesive with acrylics.

* * * * *